United States Patent [19]

Seilenbinder

[11] Patent Number: 5,007,388

[45] Date of Patent: Apr. 16, 1991

[54] HYDRAULIC VALVE LIFTER

[75] Inventor: Richard W. Seilenbinder, Hales Corners, Wis.

[73] Assignee: Briggs & Stratton Corporation, Wauwatosa, Wis.

[21] Appl. No.: 512,767

[22] Filed: Apr. 23, 1990

[51] Int. Cl.[5] ..... F01L 1/14; F01L 1/24

[52] U.S. Cl. ..... 123/90.55; 123/90.56

[58] Field of Search ..... 123/90.27, 90.55, 90.56, 123/90.63

[56] References Cited

U.S. PATENT DOCUMENTS

| | | | |
|---|---|---|---|
| 1,210,871 | 1/1917 | Suffa | 123/90.35 |
| 2,010,167 | 8/1935 | Tibbetts | 123/90.55 |
| 2,019,444 | 10/1935 | Church | 123/90.56 |
| 2,668,524 | 2/1954 | Randol | 123/90.55 |
| 2,931,347 | 4/1960 | Williams | 123/90.16 |
| 3,179,094 | 4/1965 | Ribeton | 123/90.55 |
| 3,382,854 | 5/1968 | Steiner | 123/90.16 |
| 3,742,921 | 7/1973 | Rendine | 123/90.55 |
| 3,875,908 | 4/1975 | Ayres | 123/90.63 |
| 4,020,806 | 5/1977 | Aoyama et al. | 123/90.55 |
| 4,291,652 | 9/1981 | Trzoska | 123/90.57 |
| 4,602,597 | 7/1986 | Rhoads | 123/90.63 |
| 4,624,224 | 11/1986 | Kodama et al. | 123/90.55 |
| 4,798,180 | 1/1989 | Okabe et al. | 123/90.55 |
| 4,815,424 | 3/1989 | Buuck et al. | 123/90.55 |

FOREIGN PATENT DOCUMENTS

| | | | |
|---|---|---|---|
| 2504707 | 3/1976 | Fed. Rep. of Germany | 123/90.55 |
| 2935751 | 3/1981 | Fed. Rep. of Germany | 123/90.55 |
| 206915 | 10/1985 | Japan | 123/90.55 |
| 8605238 | 9/1986 | PCT Int'l Appl. | 123/90.55 |

OTHER PUBLICATIONS

"Dyke's Automobile and Gasoline Engine Encyclopedia," Dyke, A. L. 1943, pp. 57–59, Chicago, The Goodheart-Willcox Co.

*Primary Examiner*—Willis R. Wolfe
*Assistant Examiner*—Tom Moulis
*Attorney, Agent, or Firm*—Andrus, Sceales, Starke & Sawall

[57] ABSTRACT

A hydraulic valve lifter is disclosed which does not require a source of pressurized lubricating fluid, and is particularly suitable for engines using a splash lubrication system. The engine crankcase oil is transferred from the cam surface through a check valve into the pressure chamber of the lifter. The check valve is operated by the pressure differential between the chamber pressure and the pressure at the cam surface. The check valve may also be operated by the cam itself.

10 Claims, 2 Drawing Sheets

HYDRAULIC VALVE LIFTER

BACKGROUND OF THE INVENTION

This invention relates to internal combustion engines, and more particularly to hydraulic valve lifters for small engines used on lawn mowers, snow blowers, generators and the like.

Valve lifters have been used for some time in automobile engines to open the intake and exhaust valves of the cylinder by lifting them off of their valve seats. A typical valve lifter is positioned in the valve train assembly between a cam located on a camshaft and the valve stem or push-rod that is interconnected with the valve itself. A cam follower, typically a face surface on the lifter, engages a cam on the camshaft to move the lifter in an upward direction, thereby also moving the valve stem or push-rod to open the valve.

One function of the valve lifter is to prevent unnecessary engine noise caused by air gaps in the valve train assembly. As the push-rod, valve stem, valve lifter, or other components in the valve train wear due to use, gaps appear between these components. To prevent unnecessary noise or engine clatter, the valve lifter is often manually-adjustable to remove these gaps. A typical manually-adjustable valve lifter uses a thread and nut arrangement, with the nut being turned by a wrench to extend the length of the valve lifter and remove the air gap.

More recently, hydraulic valve lifters have been used which are largely self-adjusting. In a hydraulic valve lifter, an outer cylinder has an axial bore in which a plunger or piston is located, as well as a hydraulic fluid and typically a spring mechanism. The axial movement of the outer cylinder in response to cam rotation causes the piston to axially move as well, with the compression of the spring mechanism and the hydraulic fluid preventing gaps in the valve train assembly. The valve train load is thus supported by the hydraulic fluid, the piston, and the spring.

Hydraulic valve lifters by definition require a hydraulic or working fluid to operate. In a typical prior art hydraulic valve lifter, the hydraulic fluid is supplied from the engine's pressurized lubrication system via an oil pump or the like. In such devices, the hydraulic fluid, which is typically oil or another lubricating fluid, is pumped by an oil pump through various piping into a reservoir or chamber in the hydraulic valve lifter. One disadvantage of such prior art hydraulic lifters is the additional costs of the oil pump and the required piping to provide a pressurized fluid to the lifter.

Another disadvantage of such prior art lifters is that they are not suitable for use on certain small engines that do not require an oil pump to lubricate the other moving components of the engine. If the engine uses a pressurized lubricating system to lubricate moving components such as the crankshaft and the piston connecting rods, then that oil pump may also be used to supply pressurized fluid to the hydraulic valve lifter. However, many single or two-cylinder engines do not use a pressurized lubricating system, and thus do not have an oil pump. Such engines typically use a so-called splash method of lubrication, in which a rotating shaft—typically in an oil slinger mechanism—passes through the crankcase oil and flings or splashes the oil onto other engine components to lubricate them. Engines using the splash system of lubrication typically have not used hydraulic valve lifters since such engines do not have oil pumps to provide pressurized fluid to the lifters, and since it is not economically feasible to provide a pressurized lubricating system merely for use with the hydraulic valve lifters. In short, small engines using the splash method of lubrication have typically been noisier during operation since heretofore the quieter hydraulic valve lifters have been unsuitable for use with such engines.

SUMMARY OF THE INVENTION

A hydraulic valve lifter for internal combustion engines is provided that is particularly suitable for small one or two-cylinder engines that use the splash system of lubrication. The valve lifter according to the present invention does not require any pressurized lubricating system as a source for the hydraulic or lubricating fluid used in the lifter. The lubricating fluid from the crankcase is used as both the hydraulic and lubricating fluid for the valve lifter.

The hydraulic valve lifter preferably includes an axially movable cylinder having an axial bore therein and having a lifter face that acts as a cam follower by engaging a cam on an engine camshaft. A piston is axially slidable within the cylinder's axial bore. The piston has a valve end that engages a member interconnected with a valve, such as a valve stem or a push-rod. The piston also has a base end that engages an outer spring disposed within a chamber located within the axial bore and adjacent the base end of the piston.

A valve means, such as a check valve, provides fluid communication between the chamber on the one hand and the crankcase and cam on the other hand. The valve means is used for transferring hydraulic fluid from the crankcase to the chamber in response to a pressure decrease within the chamber that results from the upward axial movement of the piston away from the cam as the lifter face engages the dwell portion of the cam.

In a preferred embodiment, the reduced pressure in the chamber alone lifts the valve off of its seat, causing hydraulic fluid to be both wiped from the cam surface into the lifter as well as sucked into the lifter. In other embodiments, the decreased pressure in the chamber as well as the cam's dwell surface lift the transferred from the crankcase via the cam surface into the lifter.

In one embodiment, the valve means comprises a check valve, such as a ball valve, in which the ball or other valve member is retained by an inner spring lying within the outer spring. A sealing means, such as an O-ring, may also be used to seal a portion of the axial bore that lies between the piston and the cylinder to prevent escape of the hydraulic fluid during lifter operation.

The valve lifter also preferably includes a limiting means for limiting the axial movement of the piston during compression of the valve lifter.

It is a feature and an advantage of the present invention to provide a hydraulic valve lifter for engines using the splash method of lubrication.

It is another feature and advantage of the present invention to provide a self-adjusting valve lifter that automatically eliminates valve train gaps due to wear and engine thermal expansion and thus reduces engine noise.

It is yet another feature and advantage of the present invention to provide a self-actuating hydraulic valve lifter that does not require a source of pressurized fluid for its operation.

These and other features and advantages of the present invention will be apparent to those skilled in the art from the following detailed description and the attached drawings, in which:

DETAILED DESCRIPTION OF PREFERRED EMBODIMENTS

Figure 1:
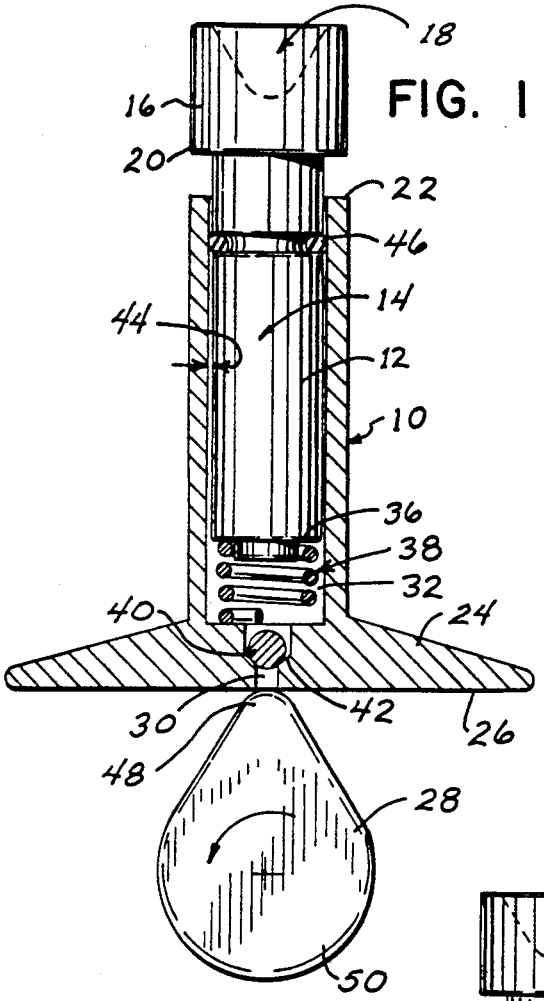
FIG. 1 is a cross-sectional view of the preferred embodiment of the present invention.

FIG. 1 depicts the preferred embodiment of the present invention. In FIG. 1, the lifter consists of a cylinder 10 having an axial bore 12 therein in which a plunger or piston 14 is axially slidable. Piston 4 has a valve end 16 which includes a pocket 18 for receiving a valve member such as a valve stem or a push-rod (not shown). Valve end 16 of piston 14 also includes a shoulder 20 which abuts a shoulder 22 on cylinder 20 to limit the axial movement of the piston when the lifter is compressing or in its rest position.

Integral with cylinder 10 is a lifter base 24 having a cam follower lifter face 26 that engages a rotating cam 28. The surface of cam 28 has a hydraulic fluid such as an oil lubricant on it. If the engine uses a splash system of lubrication, cam 28 either passes through the engine crankcase oil or is splashed with such oil from other rotating engine components so that oil is deposited on the surface of cam 28. Oil from the surface of cam 28 is transferred from the crankcase and cam 28 to the inside of the hydraulic lifter in the manner discussed below.

The lifter depicted in FIG. 1 has a valve means for transferring the hydraulic or lubricating fluid from the crankcase and cam 28 to chamber 32. Chamber 32 is defined as that portion of axial bore 12 which lies between the valve means and lifter base 28 on the one hand and the base end 36 of piston 14. Chamber 32 has an outer spring 38 disposed therein that engages base end 36 of piston 14 and is compressed and extended in response to the axial movement of cylinder 10 and piston 14.

Although various types of valve means may be used in the present invention, the valve means is preferably a check valve that uses a ball, a plunger, a disk, or even a port arrangement. In the embodiment depicted in FIG. 1, any type of valve may be used for the valve means as long as the valve opens and closes in response to a pressure differential between chamber 32 and the pressure at lifter face 26. A port valve could also be used which consists of an opening in the side of cylinder 10 that allows oil to enter chamber 32, with the axial position of piston 14 allowing the port to be opened or 10 closed as required. In the preferred embodiment depicted in FIG. 1, the check valve means consists of an aperture 30, a ball 40, and a valve seat 42.

The valve lifter depicted in FIG. 1 preferably is machined such that the clearance space 44 between the inner surface of cylinder 10 and the outer surface of piston 14 is about 0.0005 inches or less. This small clearance is desirable to prevent unnecessary leakage of the hydraulic fluid from chamber 32 during lifter compression; however, the clearance is sufficient to allow trapped air to escape. As an alternative to machining the parts to create such a small clearance, an optional seal such as an O-ring seal 46 may be provided to prevent the leakage of the hydraulic fluid.

The valve lifter depicted in FIG. 1 operates in the following manner. When cam 28 rotates such that cam lobe 48 engages lifter face 26, cylinder 10 is moved in upward direction away from cam 28. At the same time, piston 14 moves in an upward direction supported by the hydraulic fluid in chamber 32 and by spring 38. Some of the hydraulic fluid in chamber 32 escapes into the clearance space 44 to permit chamber 32 to decrease in volume.

The presence of the hydraulic fluid fixes the length of the valve lifter assembly, with shoulders 20 and 22 providing a limit to the compression of the valve lifter. Shoulder 20 should abut shoulder 22 when the valve lifter is in its complete rest position to permit the engine intake or exhaust valves to fully close for installation during engine assembly.

As cam 28 rotates past cam lobe 48, cylinder 10 moves axially toward cam 28 with respect to the engine block (not shown) until lifter face 26 contacts dwell 50 of cam 28. Any excess valve train clearance would be compensated for during the dwell portion of cam rotation as spring 38 causes piston 14 to move away from cam 28 within cylinder 10.

This relative axial movement of cylinder 10 and piston 14 causes the volume of chamber 32 to increase and spring 38 to extend, resulting in a lower pressure or partial vacuum in chamber 32 with respect to the pressure present at lifter face 26. This pressure differential causes ball 40 to move off of its valve seat 42, opening a fluid passageway between the surface of cam 28 and the crankcase on the one hand and chamber 32 on the other hand.

At the same time, the cam is rotating so that its dwell 50 is now contacting lifter face 26 and wiping hydraulic or lubricating fluid from the cam surface into aperture 30. This wiping action combined with the abovedescribed pressure differential causes several drops of lubricating fluid to be transferred from the crankcase via the cam to chamber 32 and thereby provide both working hydraulic fluid and lubricating oil to the valve lifter without the need for any pressurized lubricating system.

Figure 2:
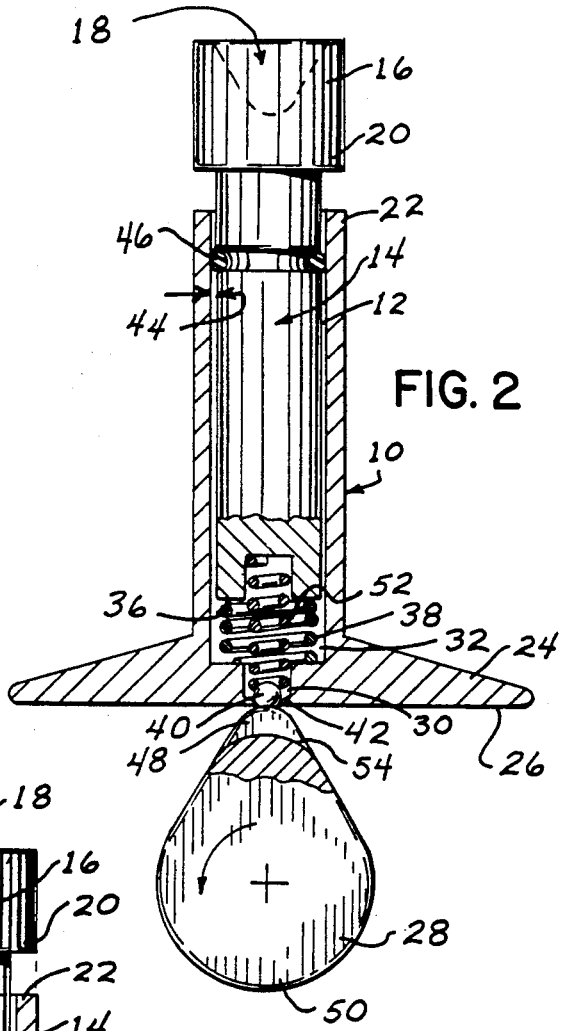
FIG. 2 is a cross-sectional view of a second embodiment of the present invention.

FIG. 2 depicts a second embodiment of the present invention. The primary differences between the embodiment depicted in FIG. 2 and the preferred embodiment of FIG. 1 is that ball 40 of the check valve depicted in FIG. 2 actually contacts dwell 50 of cam 28, and the FIG. 2 embodiment has an inner spring 52 situated inside outer spring 38. Inner spring 52 helps retain ball 40 on its valve seat 42, and provides an opposing force when ball 40 engages cam dwell 50.

Figure 3:
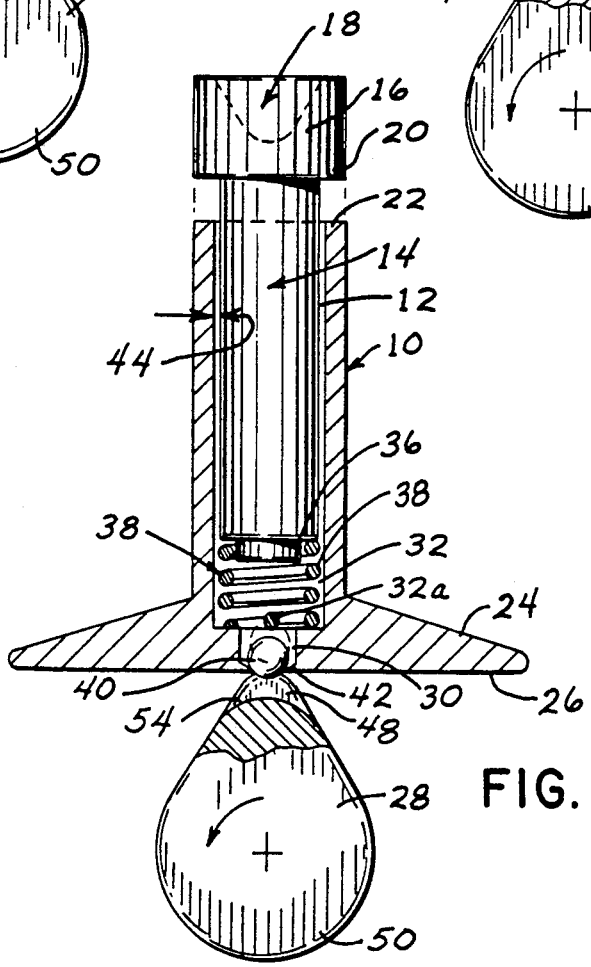
FIG. 3 is a cross-sectional view of a third embodiment of the present invention.

Although several different check valves could be used with the embodiments depicted in FIGS. 2 and 3, a ball or plunger type of valve is desirable since a surface on the valve must contact cam dwell 50. A ball check valve is preferred, since the rolling action of the ball minimizes wear and pitting due to dirt at any specific location on the surface of the ball. A plunger member may be more prone to wear at a particular point on its contact surface.

Another difference between the embodiments depicted in FIGS. 2 and 3 and the preferred embodiment of FIG. 1 is that the cam 28 in FIGS. 2 and 3 is specially machined with a groove 54 in cam lobe 48 to prevent ball 40 from moving off its valve seat 42 when cam lobe 48 engages lifter face 26.

In FIGS. 1, 2 and 3, components having corresponding functions have been given the same numerical designations, it being understood that the precise configurations and dimensions of the components may be varied depending on the particular embodiment.

The embodiment depicted in FIG. 3 is similar to the embodiment depicted in FIG. 2 and operates in a similar manner, except that the embodiment depicted in FIG. 3 does not have the O-ring seal 46 in FIG. 2, and does not require the inner spring 52 of FIG. 1. An overcenter bend on ball end 32*a* of spring 32 prevents travel of ball 40 out of the space defined by spring 32 and aperture 30.

The primary difference in the operations of the preferred embodiment of FIG. 1 and the embodiments depicted in FIGS. 2 and 3 is that the valve in FIG. 1 is opened exclusively by a pressure differential that occurs when the pressure in chamber 32 is lower than the pressure at lifter face 26 or aperture 30. Similarly, the valve in FIG. 1 is closed exclusively by a pressure differential that occurs when the relative downward axial motion of piston 14 increases the pressure in chamber 32 such that the pressure in chamber 32 is greater than the pressure at lifter face 26 or aperture 30.

In the embodiments depicted in FIGS. 2 and 3, the valve is opened both by the above-discussed pressure differential and by the engagement of the valve with dwell 50 of cam 28. In both FIGS. 2 and 3, the force imposed by dwell 50 is opposed by a spring; in FIG. 2 the force imposed by the cam is opposed by inner spring 52, whereas in FIG. 3 the cam's force is opposed by outer spring 38.

In FIGS. 2 and 3 the valve is closed both by the increased pressure in chamber 32 as discussed above in connection with FIG. 1, and by the compression forces of spring 52 (FIG. 2) and of spring 38 (FIG. 3).

The operation of the embodiments depicted in FIGS. 2 and 3 will be discussed with reference to FIGS. 4A–4D.

Figure 4D:
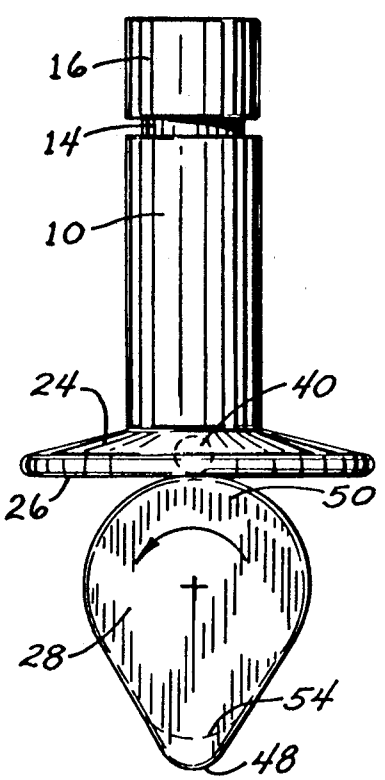
FIGS. 4A –4D depict the operation of the hydraulic valve lifters in the second and third embodiments of the present invention.
Figure 4C:
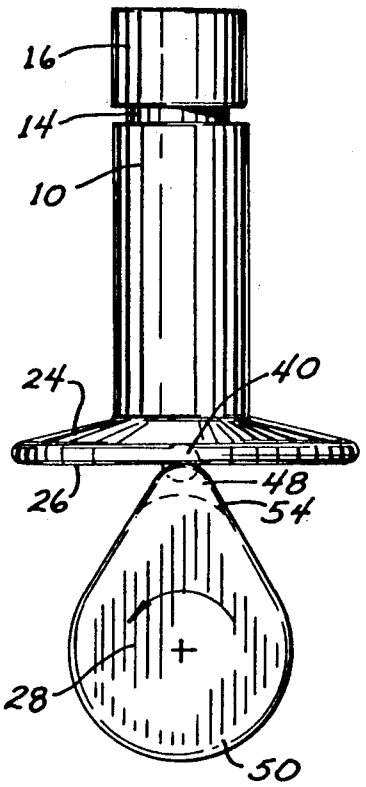
Figure 4B:
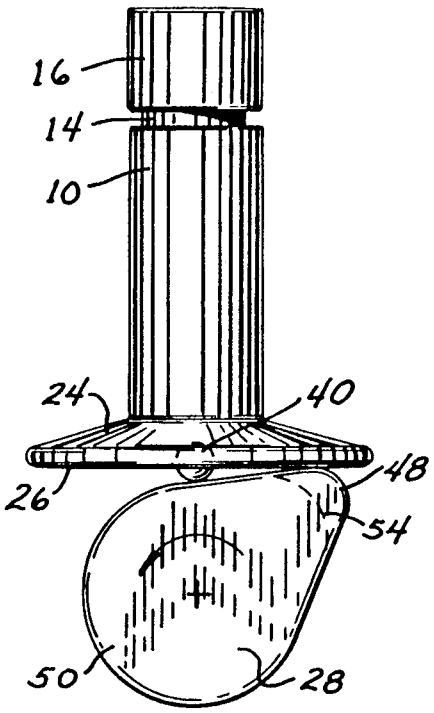
Figure 4A:
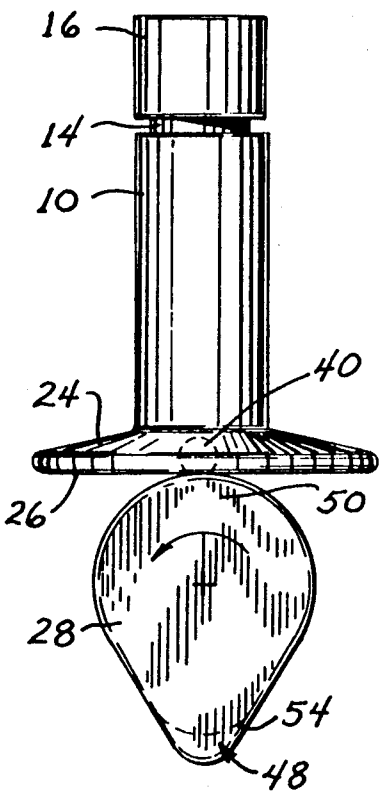

FIG. 4A depicts the valve lifter when lifter face 26 and ball 40 of the valve are engaging dwell 50 of cam 28. At this point, ball 50 is retracted inward toward piston 14. At the same time, piston 14 is moving in an axial direction away from cam 14 relative to cylinder 10, creating an increased volume and thus a lower pressure in chamber 32 (FIGS. 2 and 3). Since valve 40 is now open, hydraulic fluid on the surface of dwell 50 is wiped and sucked through the valve into chamber 32. The spring or springs within chamber 32 are expanding to extend the valve lifter.

As cam 28 rotates past dwell 50, it reaches the position depicted in FIG. 4B. In this position, cam lobe 48 is just beginning to lift cylinder 10, and the lifter valve is closing. The closing of the lifter valve traps the hydraulic fluid inside chamber 32 to maintain or fix the lifter at its current length.

As cam 28 continues to rotate, cam lobe 48 engages lifter face 26 to push lifter cylinder 10 in an axial direction away from cam dwell 50. The valve remains closed due to the groove 54 which has been machined into cam lobe 48.

As cam 28 continues to rotate, it reaches the position depicted in FIG. 4, which is the same position as that of FIG. 1. In this position, the lifter valve is now open and the lifter length can self-adjust to eliminate gaps in the valve train assembly.

In any of the embodiments of the present invention, approximately several drops of the lubricating or hydraulic fluid enter the valve lifter during each camshaft revolution. The lifter is designed such that it can hold approximately 1 to 4 cubic centimeters of the hydraulic fluid, with about 2 cubic centimeters being optimum. Of course, some of the hydraulic fluid may leak through the valve mechanism or through clearance space 44, but is quickly replenished during successive camshaft revolutions.

Although several embodiments of the invention have been shown and described, alternate embodiments will be apparent to those skilled in the art and are within the intended scope of the present invention. Therefore, the present invention is to be limited only by the following claims.

I claim:

1. A hydraulic lifter for an internal combustion engine having a crankcase containing a hydraulic fluid, comprising:

an axially movable cylinder having an axial bore therein and having a lifter face that engages a cam on a camshaft;

a piston having a valve end and a base end, said piston being axially slidable within the axial bore, and the valve end of said piston engaging a valve member interconnected with an engine valve;

a chamber located within said axial bore and adjacent the base end of said piston;

an outer spring, disposed within said chamber that engages said piston base end; and valve means in fluid communication with both said chamber and with said crankcase for transferring hydraulic fluid from said crankcase to said chamber in response to a pressure decrease within said chamber.

2. The valve lifter of claim 1, further comprising:

an inner spring disposed inside said outer spring that engages said valve means.

3. The valve lifter of claim 1, further comprising:

sealing means for sealing a portion of the axial bore lying between the piston and the cylinder.

4. The valve lifter of claim 3, wherein said sealing means is an O-ring.

5. The valve lifter of claim 1, wherein said valve means comprises a check valve.

6. The valve lifter of claim 2, wherein said valve means is a ball check valve and said ball engages said inner spring.

7. The valve lifter of claim 1, wherein said valve means is disposed near said lifter face such that said valve means is engaged by said cam.

8. The valve lifter of claim 7, wherein said cam has a lobe with a groove to prevent said lobe from engaging said valve means when the lobe engages said lifter face.

9. The valve lifter of claim 1, further comprising:

limiting means for limiting the axial movement of said piston.

10. The valve lifter of claim 9, wherein said limiting means includes a shoulder on said piston that engages said lifter cylinder to limit axial movement of said piston during lifter compression.

* * * * *